US009547275B1

(12) United States Patent
Blair et al.

(10) Patent No.: US 9,547,275 B1
(45) Date of Patent: Jan. 17, 2017

(54) FUSER LOCKING ASSEMBLY FOR AN ELECTROPHOTOGRAPHIC IMAGING DEVICE

(71) Applicant: Lexmark International, Inc., Lexington, KY (US)

(72) Inventors: Brian Allen Blair, Richmond, KY (US); Richard Gordon Boyatt, III, Lexington, KY (US); Darin Michael Gettelfinger, Lexington, KY (US); Alexander Johannes Geyling, Lexington, KY (US); Edward Lawrence Kiely, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/948,952

(22) Filed: Nov. 23, 2015

(51) Int. Cl.
*G03G 15/20* (2006.01)
*G03G 21/16* (2006.01)

(52) U.S. Cl.
CPC ..... *G03G 21/1685* (2013.01); *G03G 15/2064* (2013.01); *G03G 15/2071* (2013.01); *G03G 21/16* (2013.01); *G03G 2221/1639* (2013.01); *G03G 2221/1675* (2013.01)

(58) Field of Classification Search
CPC ..... G03G 15/20
USPC ..... 399/122
See application file for complete search history.

(56) References Cited

U.S. PATENT DOCUMENTS

2007/0297831 A1* 12/2007 Koyanagi ..... G03G 15/605 399/211
2009/0010680 A1* 1/2009 Nanno ..... G03G 15/20 399/122
2014/0294428 A1* 10/2014 Iketani ..... G03G 21/1666 399/98

* cited by examiner

*Primary Examiner* — Clayton E Laballe
*Assistant Examiner* — Kevin Butler

(57) ABSTRACT

An imaging device, including a locking assembly connected to the frame of the imaging device and selectively engaged with the fuser assembly thereof when the fuser assembly is mounted to the frame. The locking assembly includes a lock member slidingly coupled to the frame between a first position in which the lock member engages with the fuser assembly for locking the fuser assembly to the frame and a second position in which the lock member is disengaged from the fuser assembly to allow the fuser assembly to be disconnected and removed from the frame. A lever mechanism is movably coupled to the frame and coupled to the lock member, wherein actuation of the lever mechanism moves the lock member between the first position and the second position.

21 Claims, 10 Drawing Sheets

FUSER LOCKING ASSEMBLY FOR AN ELECTROPHOTOGRAPHIC IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to securing a fuser assembly in an electrophotographic imaging device, and particularly to a lock mechanism which locks the fuser assembly in the imaging device while being transparent to a user thereof.

2. Description of the Related Art

Within an electrophotographic (i.e., laser) printing device, a fuser assembly is employed to adhere or fuse toner particles to sheets of media via application of heat and pressure. The fuser assembly is disposed downstream of the image transfer station of the imaging device. The location of the fuser assembly relative to the media alignment and the image transfer station serves to mitigate twist, treeing, and print defects as the media passes through the fuser assembly. It is desired to locate the fuser assembly in a manner that is largely co-planar to the media sheet through a number of datum points. However, applying a holding force to the fuser assembly that is generally centered between the datum points is often difficult to achieve. This is mostly due to the need to attach the fuser assembly at locations outside of the width of the paper-path and away from the backup roll and belt of the fuser assembly. With the proper design, the fuser assembly can be located relatively accurately and precisely to the media sheet and image transfer station for normal operating conditions, but during a drop event, damage can occur due to the non-centered attachment scheme. A secondary mechanism is often utilized to eliminate damage that could occur if the imaging device is dropped during shipment.

SUMMARY

Example embodiments are directed to a locking assembly for the fuser assembly of an imaging device to secure the fuser assembly into its operable position in the imaging device. The locking assembly is connected to the frame and selectively engaged with the fuser assembly when the fuser assembly is mounted to the frame, and includes a lock plate movably positioned along the frame between a first position in which the lock plate engages with the fuser assembly for locking the fuser assembly to the frame and a second position in which the lock plate is disengaged from the fuser assembly to allow the fuser assembly to be disconnected and removed from the frame.

According to an example embodiment, the frame includes a mounting plate to which the fuser assembly is mountable.

The lock plate is slidable along the mounting plate, wherein when the lock plate is in the first position, the lock plate engages with the feature of the fuser assembly so as to prevent the fuser assembly from disconnecting from the mounting plate and when the lock plate is in the second position, the lock plate disengages from the feature of the fuser assembly so as to allow for the disconnection and removal of the fuser assembly from the frame. A bias member is connected between the lock plate and the mounting plate, the bias member urging the lock plate towards the second position.

The locking assembly further includes a lever mechanism coupled to the lock plate and the mounting plate, wherein actuation of the lever mechanism slides the lock from the second position to the first position to lock the fuser assembly to the frame.

The imaging device further includes a door having a first end portion pivotably coupled to the frame, the door pivoting between a closed position and an open position in which a second end portion of the door is positioned away from the frame, the door including a pivot arm which contacts and actuates the lever mechanism when the door is in the closed position so as to cause the lock plate to move to the first position to lock the fuser assembly to the frame.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
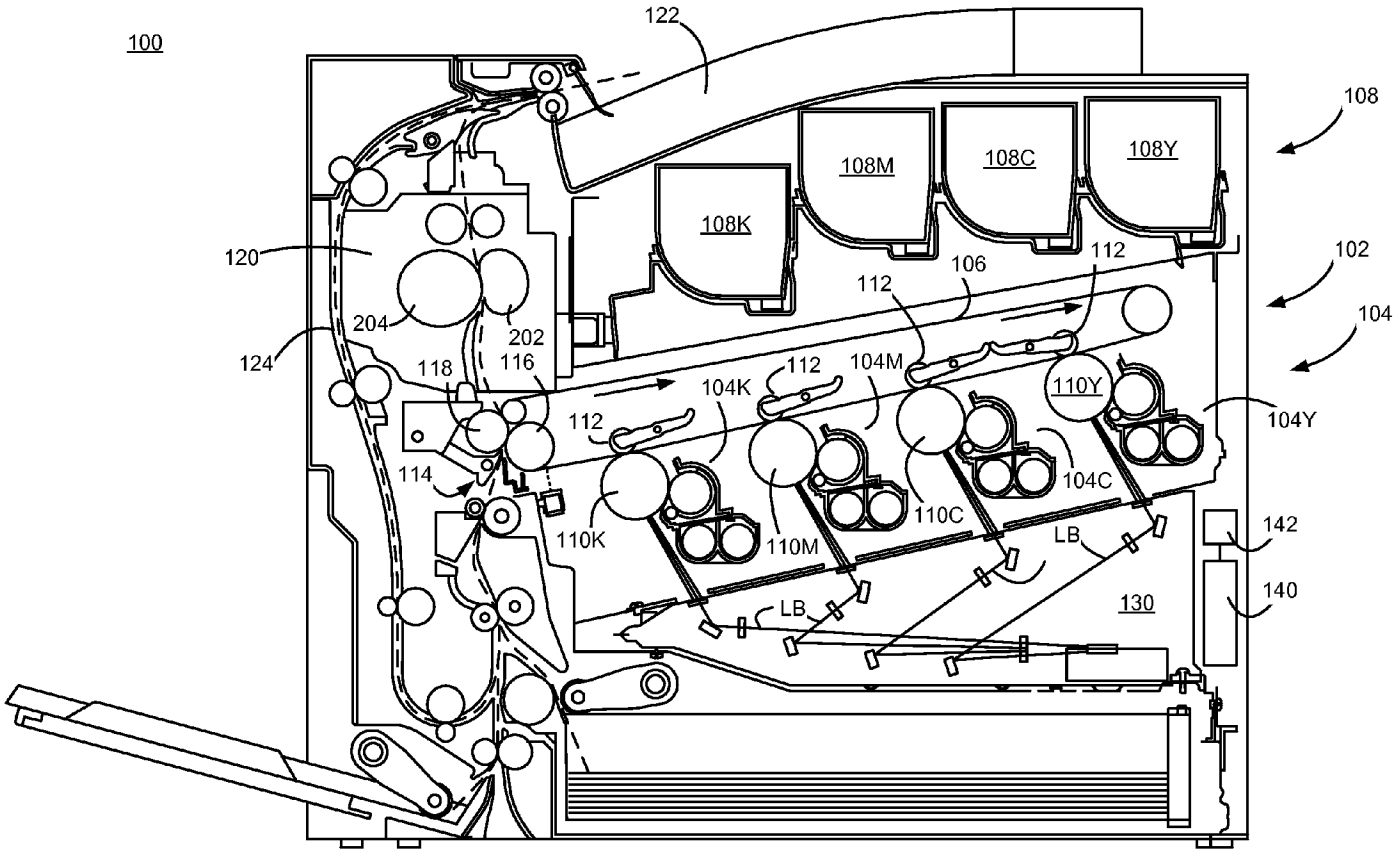
FIG. 1 is a side elevational view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104 that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 (108K, 108M, 108C and 108Y) for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming or imaging operations, ITM 106 moves past photoconductive members 110 in a clockwise direction as viewed in FIG. 1. One or more of photoconductive members 110 applies its toner image in its respective color to ITM 106. For mono-color images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Figure 2:
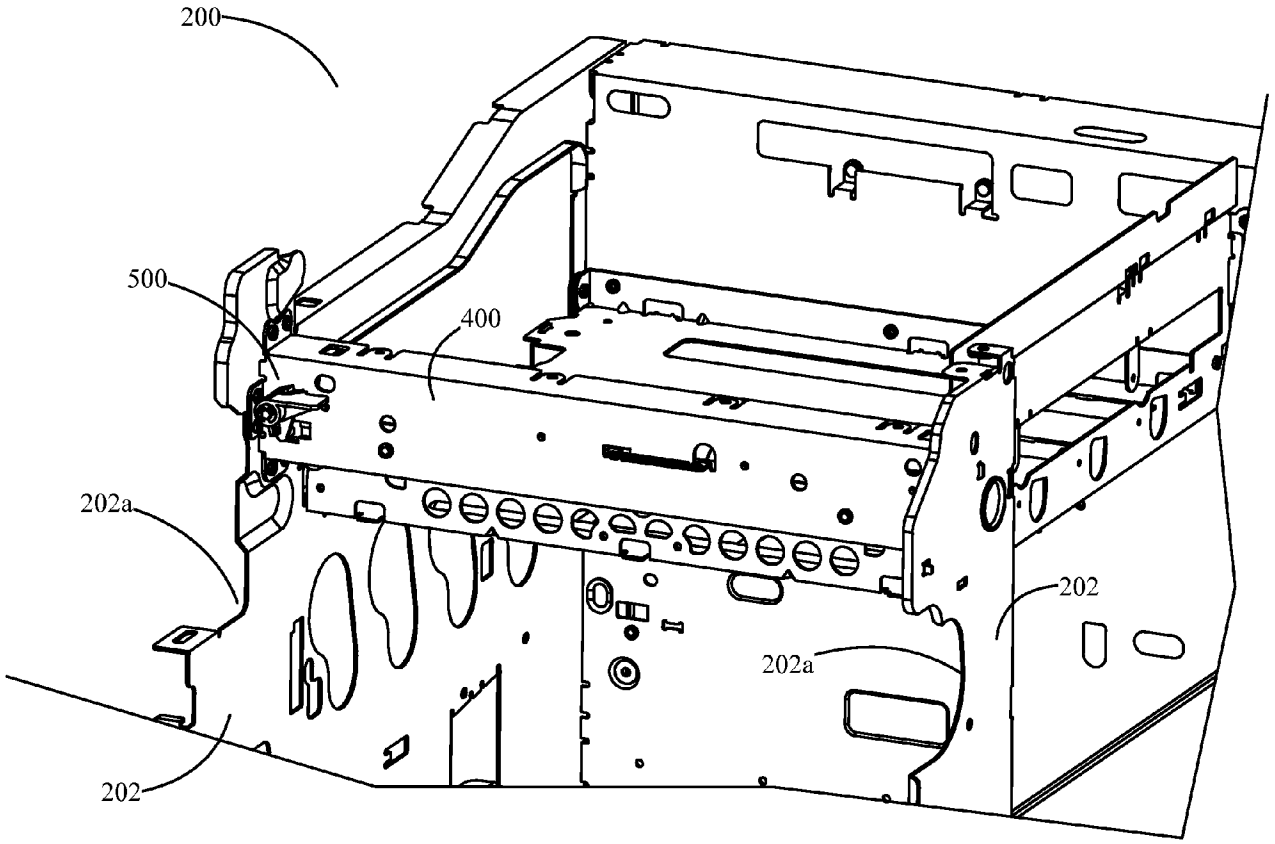
FIG. 2 is a perspective view of the frame of the imaging device of FIG. 1 according to an example embodiment.
Figure 3:
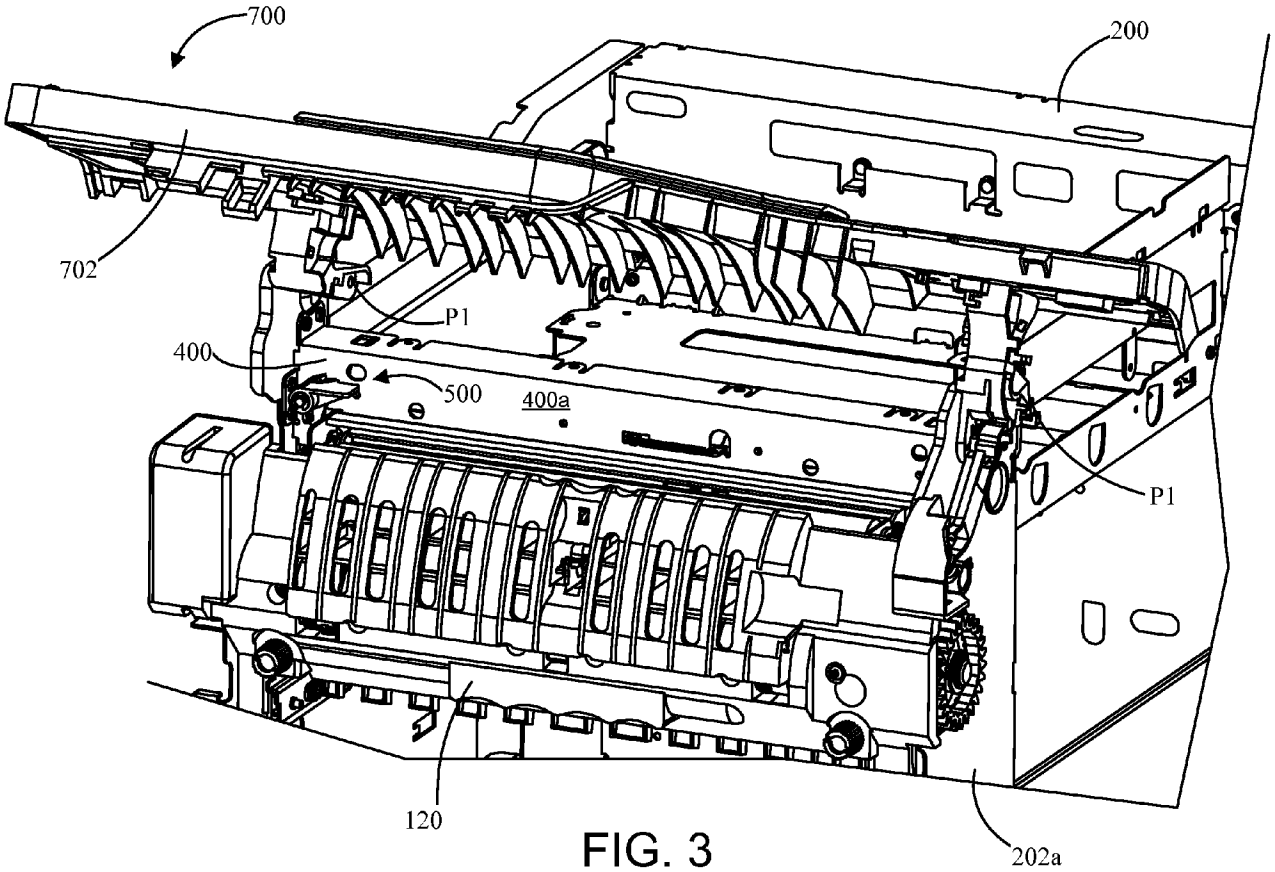
FIG. 3 is a perspective view of the frame of the imaging device of FIG. 1 with a fuser assembly mounted thereto.

Example embodiments of the present disclosure are directed to a lock mechanism for securing fuser assembly 120 of imaging device 100 to the frame thereof. FIG. 2 illustrates a portion of frame 200 of imaging device 100. In general terms, frame 200 forms the skeleton for imaging device 100, to which the modules described above with respect to FIG. 1 are attached and/or mounted. In the example embodiment, frame 200 includes side panels 202 which extend substantially vertically and are disposed along opposed sides of imaging device 100. Mounting plate 400 is disposed between side panels 202 near a front portion of imaging device 100. Fuser assembly 120 is disposed forwardly of mounting plate 400 in imaging device 100, and is disposed within the curved contours 202*a* of side panels 202. In the example embodiment, an upper part of fuser assembly 120 is mounted to mounting plate 400, as shown in FIG. 3.

Figure 5:
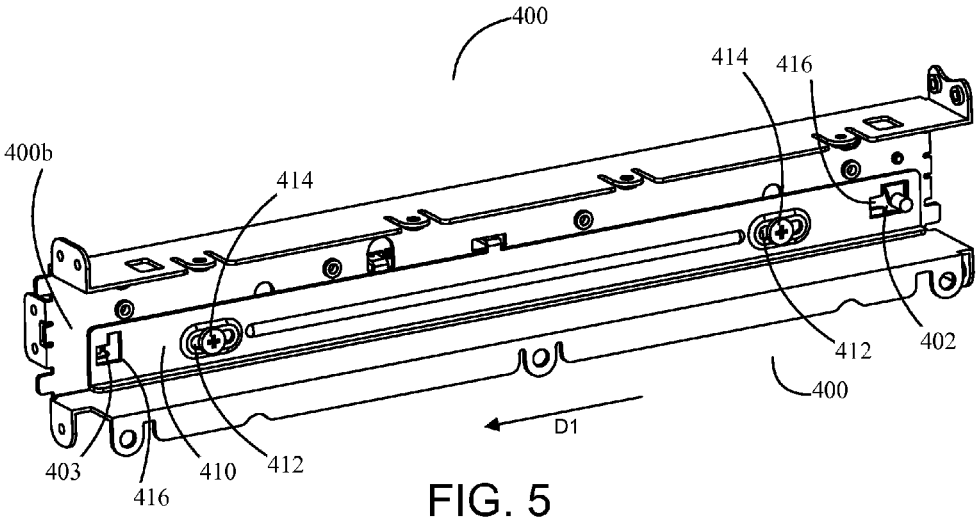
FIGS. 4 and 5 are front and back perspective views, respectively, of a portion of the frame of the imaging device of FIGS. 2 and 3 according to an example embodiment.
Figure 4:
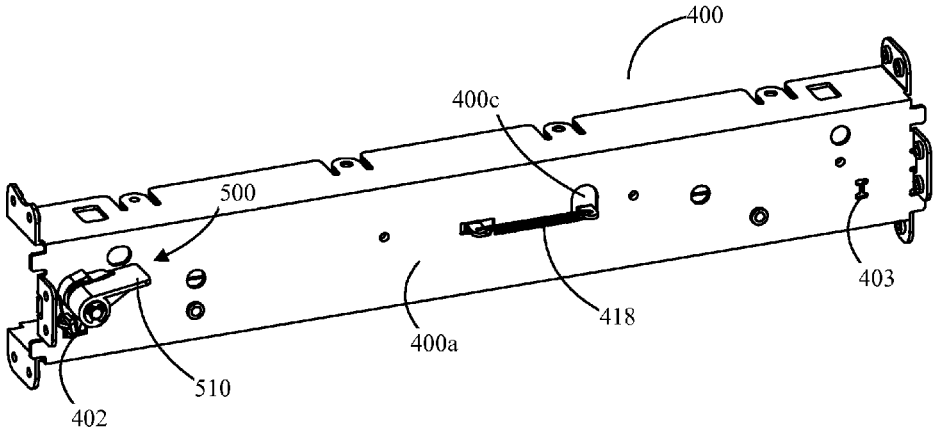

FIGS. 4 and 5 illustrate mounting plate 400, according to an example embodiment. Fuser assembly 120 is removably connected to mounting plate 400. Mounting plate includes apertures 402 and 403 through which features of fuser assembly 120 are inserted for connecting fuser assembly 120 to mounting plate 400 and thus frame 200 of imaging device 100, as explained in greater detail below. Mounting plate 400 includes a front surface 400*a* against which fuser assembly 120 is connected and/or mounted, and a back surface 400*b*.

Imaging device 100 further includes a locking assembly for locking fuser assembly 120 to mounting plate 400. In an example embodiment, the locking assembly includes a lock plate 410 (FIG. 5) which is disposed along back surface 400*b* of mounting plate 400. Lock plate 410 is configured to slide along back surface 400*b* of mounting plate 400 between positions for locking and unlocking fuser assembly 120 from frame 200. Lock plate 410 includes slots 412 which are disposed in largely length-wise end portions of lock plate 410. Shoulder screws 414 are inserted through slots 412 and threadingly engage with mounting plate 400 for maintaining lock plate 410 against back surface 400*b* of mounting plate 400 without lock plate 410 being in a fixed position relative to mounting plate 400.

Lock plate 410 further includes openings 416 (FIG. 5) disposed along the lock plate 410 in proximity with apertures 402 and 403 of mounting plate 400. The amount of overlap between apertures 402, 403 of mounting plate 400 and openings 416 of lock plate 410 depends upon the position of lock plate 410 relative to mounting plate 400. In general terms, lock plate 410 is slidable along mounting plate 400 between a first position in which a lesser amount of overlap exists between apertures 402, 403 of mounting plate 400 and openings 416 of lock 410, and a second position in which a greater amount of overlap exists. In the first position, lock plate 410 engages fuser assembly 120 so as to lock fuser assembly within imaging device 100, and in the second position, lock plate 410 disengages from fuser assembly 120 so that fuser assembly 120 may be withdrawn from imaging device 100. Spring member 418 (FIG. 4) has a first end coupled along front surface 400*a* of mounting plate 400 and a second end coupled to lock plate 410 via an opening 400*c* in mounting plate 400. Spring member 418 biases lock plate 410 towards the second position thereof in which lock plate 410 is disengaged from fuser assembly 120.

According to example embodiments, the locking assembly further includes a lever mechanism 500 which, when actuated, moves or slides lock plate 410 from the second position (in which lock plate 410 is disengaged from fuser assembly 120) to the first position (in which lock plate 410 engages with fuser assembly 120 and locks same to frame 200 of imaging device 100). With reference to FIGS. 5-9 and best seen in FIG. 6, lever mechanism 500 includes a first lever member 510, a second lever member 512, and torsion spring 514. Each of first lever member 510, second lever member 512, and torsion spring 514 is rotatably disposed about post 516 of mounting plate 400 which, in this example embodiment, extends outwardly from mounting plate 400 in a direction that is orthogonal to front surface 400*a* of mounting plate 400. First lever member 510 includes annular portion 510*a* for use in rotating about post 516 and an extension portion 510*b* which extends outwardly from annular portion 510*a*. In the example embodiment illustrated, extension portion 510*b* extends largely tangentially from annular portion 510*a*. Second lever member 512 includes annular portion 512*a* for use in rotating about post 516 and extension portion 512*b* which extends from annular portion 512*a*. Extension portion 512*b* may include a detent 512*c* disposed and extends from a distal end of extension portion 512*b*. Torsion spring 514 is disposed between first lever member 510 and second lever member 512. A first end portion 514*a* of torsion spring 514 contacts tab 510*c* which protrudes from extension portion 510*b* of first lever member 510, and a second end portion 514*b* of torsion spring 514 contacts tab 512*d* of extension portion 512*b* of second lever member 512. Torsion spring 514 is contracted when first lever member 510 is rotated in a first direction (clockwise, as viewed from FIGS. 7 and 8) relative to second lever member 512, as described in greater detail below.

Figure 7:
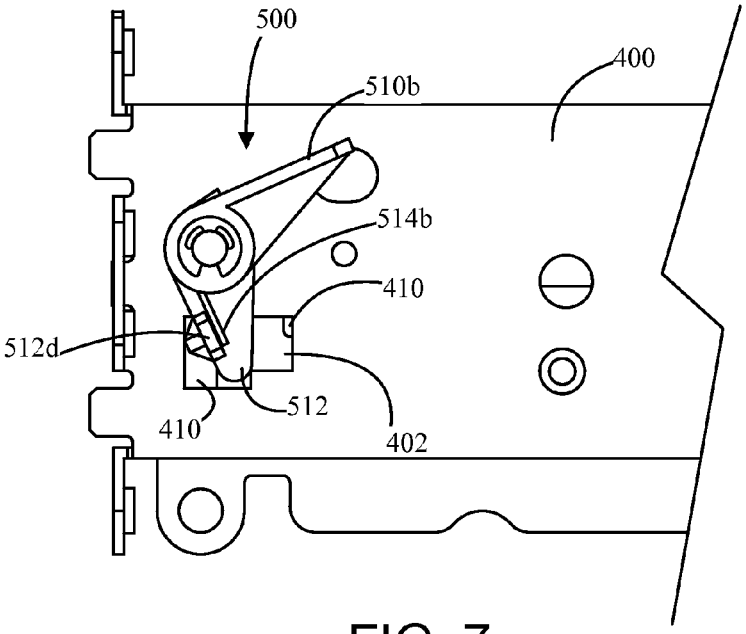
FIGS. 7 and 8 are front elevational views of the end of the frame portion of FIGS. 4 and 5 showing operation of the lever mechanism, according to an example embodiment.
Figure 10:
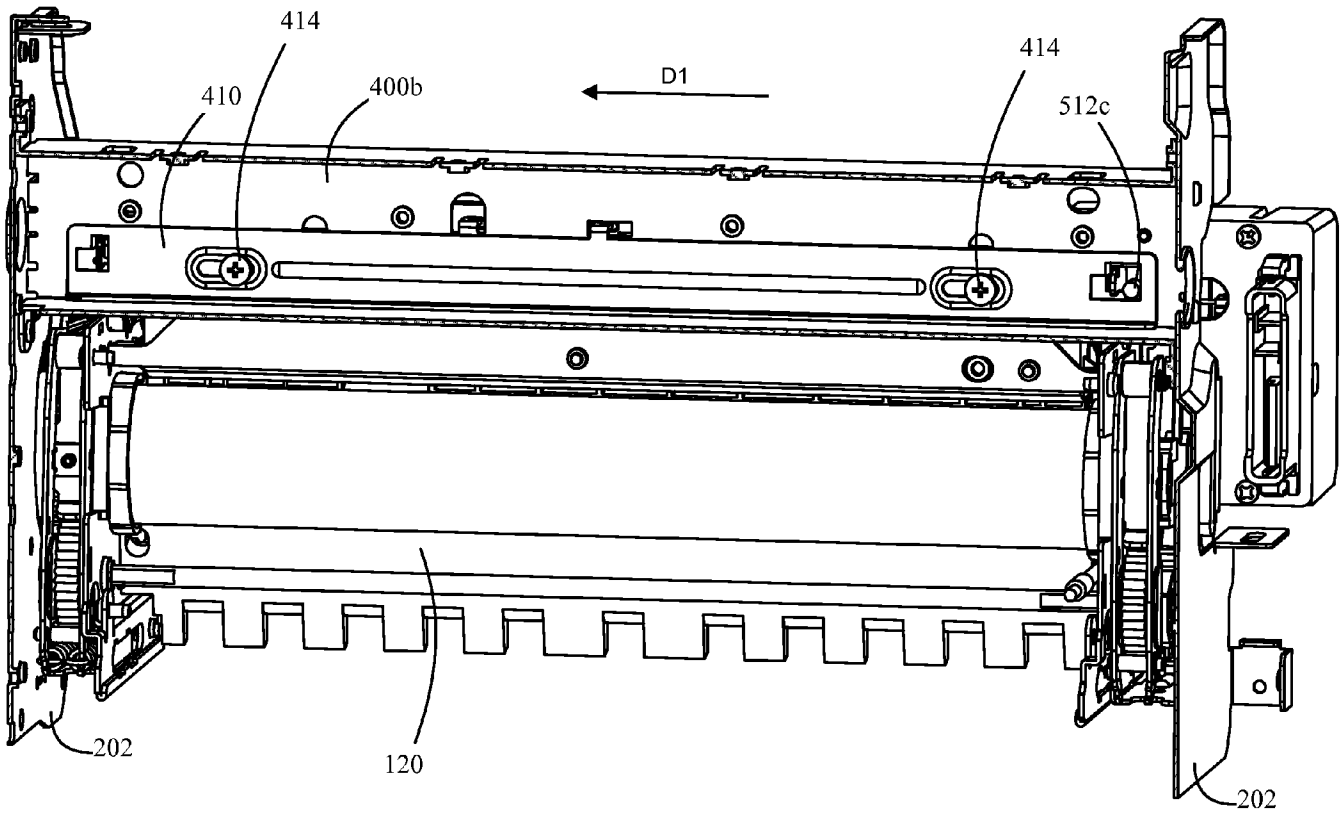
FIGS. 10 and 11 are back perspective views of fuser assembly of FIG. 1 mounted to the frame portion of FIGS. 4 and 5.

The operation of lever mechanism 500 will be described in connection with FIGS. 7 and 8. FIG. 7 illustrates lever mechanism 500 in a position in which no force is applied to first lever member 510 to actuate lever mechanism 500. With lever mechanism 500 not actuated, there are no forces applied by lever mechanism 500 to move lock plate 410, and lock plate 410 is urged in a first direction D1 (to the left in FIGS. 5, 10 and 11, and to the right in FIGS. 7 and 8) by spring member 418 to the above-described second position as a result. In this position, depicted in FIGS. 7 and 10, in which lock plate 410 is in the second position, lock plate 410 does not engage with fuser assembly 120 so that fuser assembly 120 is able to be withdrawn from imaging device 100.

Figure 9:
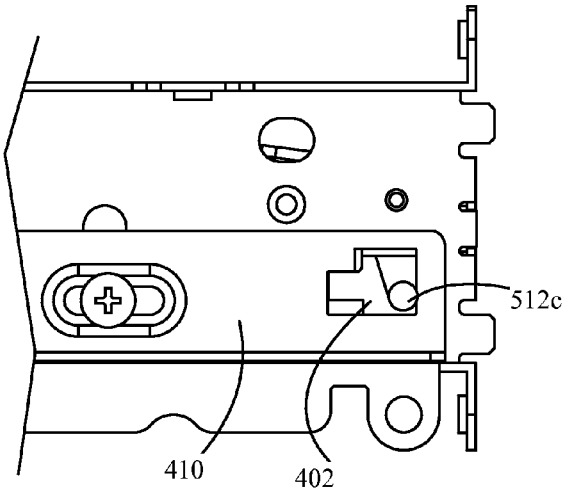
FIG. 9 is a back elevational view of the end of the frame portion of FIGS. 4 and 5 according to an example embodiment.
Figure 6:
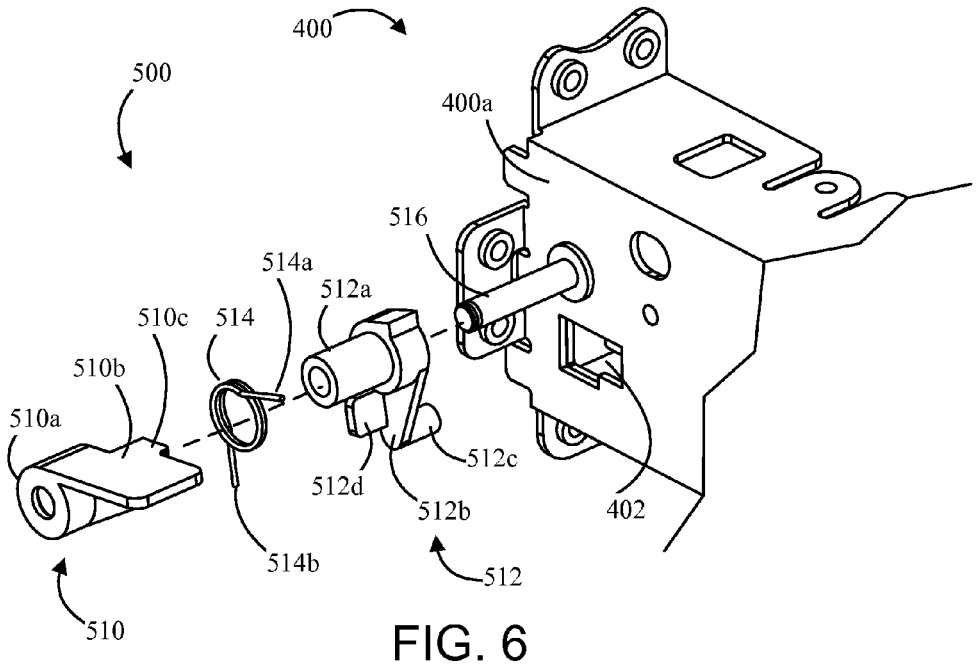
FIG. 6 is an exploded perspective view of a lever mechanism of the frame portion of FIGS. 4 and 5 according to an example embodiment.
Figure 8:
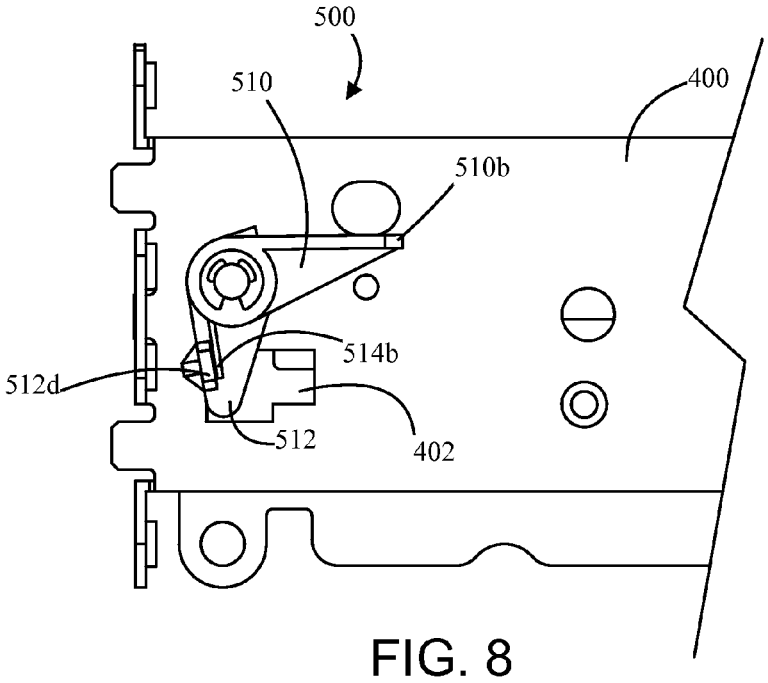
Figure 11:
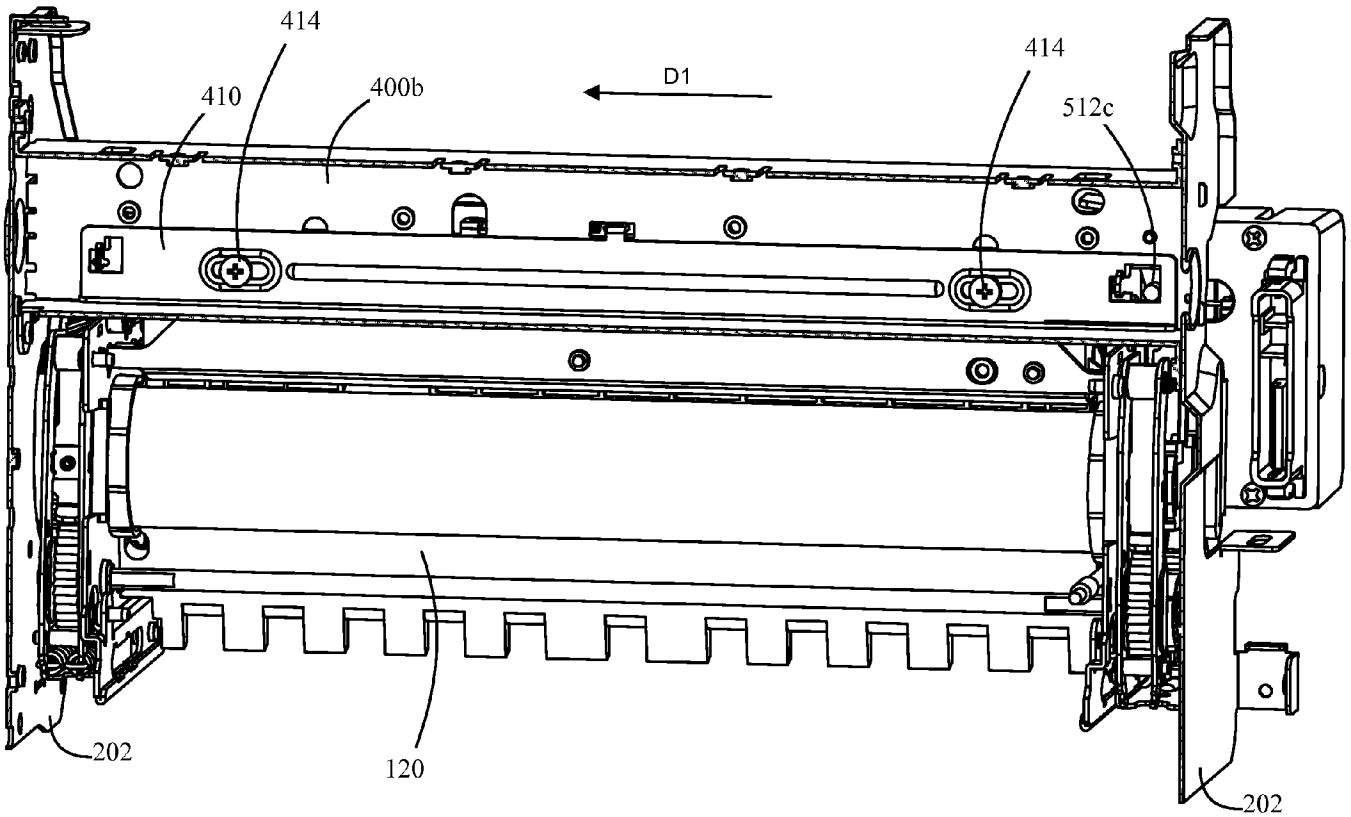

With lever mechanism 500 not actuated and lock plate 410 disposed in the second position, a largely downward force on the distal end portion of extension portion 510*b* of first lever member 510 causes first lever member 510 to rotate in the clockwise position (as viewed from FIGS. 7 and 8). Clockwise rotation of first lever member 510 rotates first end portion 514*a* of torsion spring 514 so as to contract spring 514. Eventually, a bias force is created by contracted torsion spring 514 which overcomes the bias force caused by spring member 418 and causes second end portion 514*b* of torsion spring 514 to also rotate clockwise. Rotation of second end portion 514*b* causes second lever member 512 to rotate clockwise, due to contact between second end portion 514*b* of torsion spring 514 and tab 512*d* of second lever member 512, as shown in FIG. 8. Clockwise rotation of second lever member 512 causes detent 512*c* thereof to move or slide lock plate 401 in a direction opposite to first direction D1, i.e., to the right in FIGS. 5, 10 and 11 and to the left in FIGS. 7 and 8, until lock plate 410 is in its first position (FIGS. 9 and 11). In this way, actuation of lever mechanism 500 moves lock plate 410 from its second position to its first position. With lock plate 410 is in its first position, a portion of lock plate 410 covers a portion of apertures 402 and 403 of mounting plate 400 which engages with fuser assembly 120 so that fuser assembly 120 cannot be removed from imaging device 100.

Figure 12:
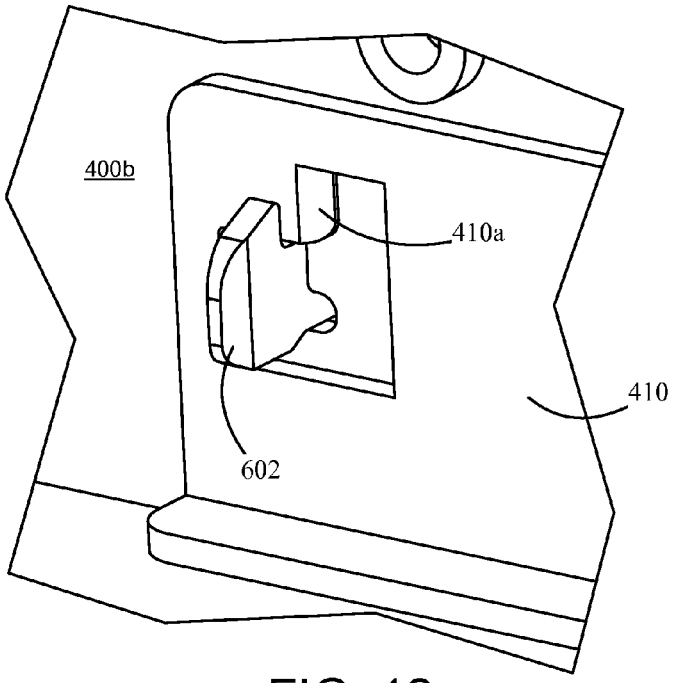
FIGS. 12 and 13 are perspective back views of an end of the frame portion of FIGS. 4 and 5, according to an example embodiment.
Figure 13:
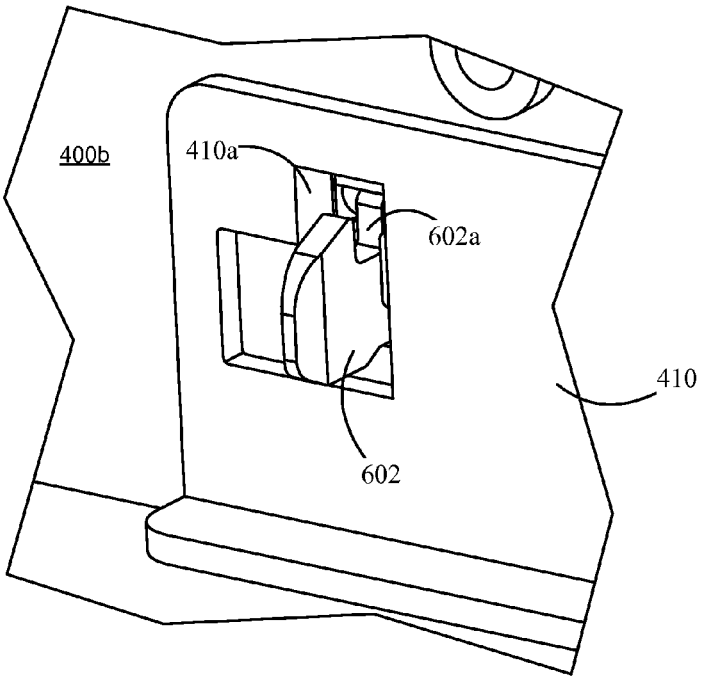

Fuser assembly 120 includes a frame having mounting features 602 which engage with mounting plate 400 so that fuser assembly 120 is at least partly mounted to frame 200 via mounting plate 400. As shown in FIGS. 12 and 13, each mounting feature 602 is sized so as to be insertable through apertures 402 and 403 of mounting plate 400 as well as openings 416 of lock plate 410. Mounting feature 602 includes a notch 602*a* (FIG. 13) which is itself sized so that lock plate 410 may be slid between mounting feature 602 and mounting plate 400 when lock plate 410 is in the first position. In addition, the portion of lock plate 410 which slides between mounting feature 602 and lock plate 410 includes a tapered portion 410*a* to provide for smoother sliding of lock plate 410 when lock plate 410 is moved from the second position (FIG. 13) in which lock plate 410 is disengaged from fuser assembly 120 (for selective removal of fuser assembly 120 from imaging device 100) to the first position (FIG. 12) in which lock plate 410 is engaged with fuser 120 for locking fuser assembly 120 to mounting plate 400 and/or frame 200. When lock plate 410 is engaged with mounting features 602 so as to lock fuser assembly 120 to frame 200 of imaging device, forces generated during a drop event are largely grounded through lock plate 410 to frame 200 and thereby distributed over a much larger area (frame 200) than the amount of area receiving the generated forces had the forces been concentrated through the relatively small datum features of fuser assembly 120.

In an example embodiment, imaging device 100 includes a door 700 which, when opened, provides access to an inner space of imaging device 100. Door 700 pivots about pivot points P1, best seen in FIG. 3. Pivot points P1 form a pivot axis about which door 7 pivots between an open position, illustrated in FIG. 3, and a closed position in which door 700 is disposed against a top of frame 200. In the example embodiment illustrated in FIGS. 3 and 12, door 700 includes a display panel 702 which provides a user interface for imaging device 100.

Figure 14:
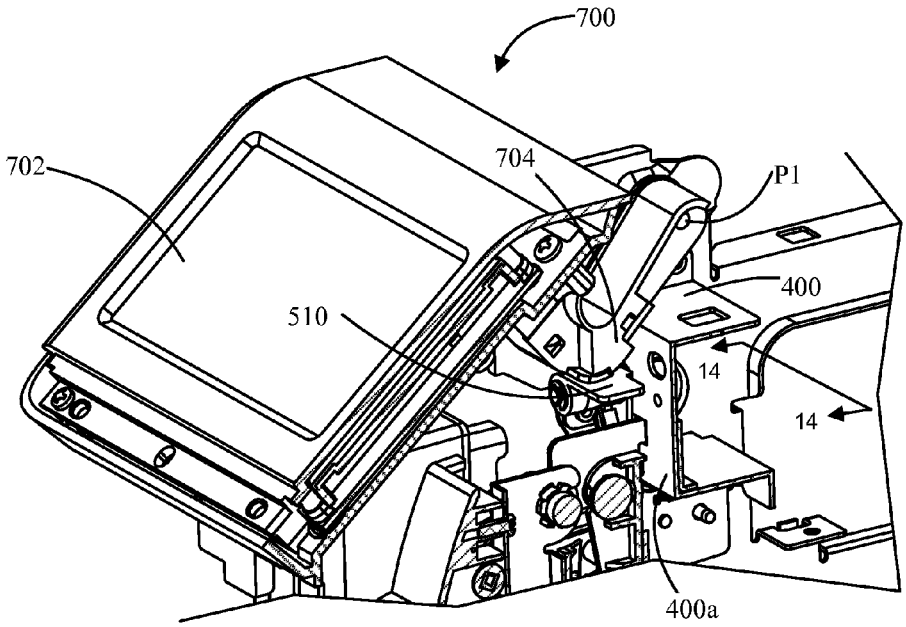
FIG. 14 is a front, cutaway perspective view of the frame portion of FIGS. 4 and 5 in association with the fuser assembly and a cover of the imaging device of FIG. 1.

As explained above, actuating lever mechanism 500 results in lock plate 410 moving to its first position in which lock plate 410 engages with mounting features 602 of fuser assembly 120 so as to lock fuser assembly 120 to frame 200. In an example embodiment, lever mechanism 500 is actuated when door 700 is closed. FIG. 14 illustrates a portion of door 700 in or near its closed position. As shown, imaging device 100 includes a pair of pivot arms 704 coupled to door 700 which define a rotational axis about which door 700 pivots relative to frame 200 in moving between closed and open positions. Each pivot arm 704 rotates with door 700 and has a first end which is pivotably coupled to frame 200 at pivot point P1. A distal end of each pivot arm 704 is connected to an inner side of door 700.

Figure 15:
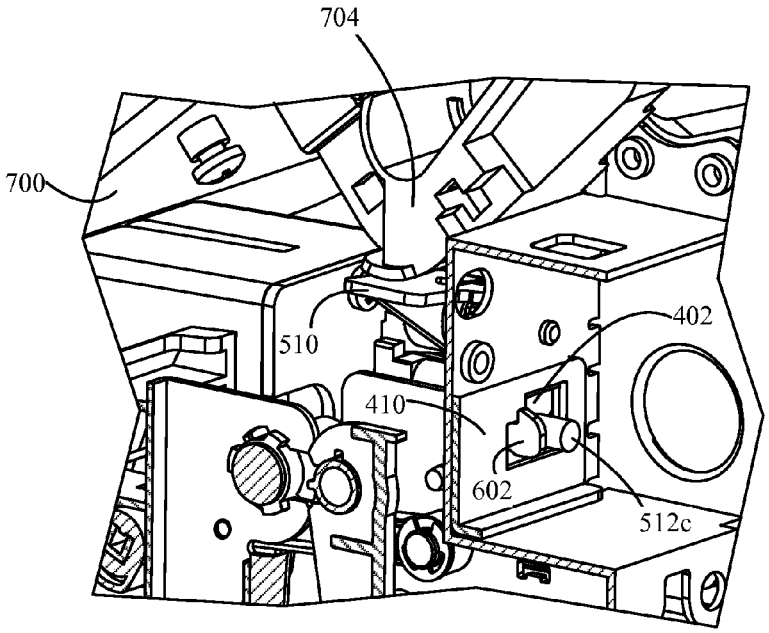
FIG. 15 is a back, cutaway perspective view of the frame portion FIG. 14 taken along the line 14-14.

During use, immediately prior to door 700 being rotated to its closed position, a surface of one of the pivot arms 704 makes contact with first lever member 510. Continued rotation of door 700 to its closed position causes pivot arm 704 to rotate largely downwardly and actuate (i.e., rotate) first lever member 510 which, as described above, causes second lever member 512 to rotate which slidingly moves lock plate 410 to its first position in which lock plate 410 engages mounting features 602 of fuser assembly 120. FIG. 15 illustrates pivot arm 704 having rotated first lever member 510 so that lock plate 410 engages with mounting feature 602. With door 700 closed, first lever member 510 remains displaced from its position when door 700 is opened and the engagement between lock plate 410 and mounting features 602 of fuser assembly 120 remains so as to lock fuser assembly 120 to frame 200. When door 700 is thereafter rotated from the closed position to the open position, pivot arms 704 are pivoted upwardly so that the pivot arm 704 no longer contacts first lever member 510 of lever mechanism 500. Without pivot arm 704 presenting a largely downward force on first lever member 510, spring member 418 causes lock plate 410 to move from its first position to its second position in which lock plate 410 no longer engages mounting features 602, thereby allowing fuser assembly 120 to be dismounted from frame 200. Lock plate 410 moving due to a bias force from spring member 418 also causes the distal end of second lever member 512 to rotate, which then causes first lever member 510 to rotate due to the presence of torsion spring 514.

The use of lock plate 410, mounting plate 400 and lever mechanism 500 in imaging device 100, as described above, ensures that fuser assembly 120 is better protected from damage from a drop event in which imaging device 100 is dropped. Another advantage of lock plate 410, mounting plate 400 and lever mechanism 500 as described above is that locking fuser assembly 120 to frame 200 (and unlocking of fuser assembly 120 therefrom) is transparent to the user of imaging device 100. Lock plate 410, mounting plate 400 and lever mechanism 500 are also robust and relatively simple in design and inexpensive to manufacture.

The description of the details of the example embodiments have been described in the context of a color electrophotographic imaging devices. However, it will be appreciated that the teachings and concepts provided herein are applicable to monochrome electrophotographic imaging devices and multifunction products employing electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is understood that lock plate 410, mounting plate 400 and lever mechanism 500 may be utilized to lock into place a number of other modules or assemblies of imaging device 100, including toner reservoirs 108, developer units 104 and photoconductive members 110. It is further understood that devices other than imaging device 100 may make use of lock plate 410, mounting plate 400 and lever mechanism 500 for locking into place modules, assemblies and subassemblies of the device. It is intended that the scope of the invention be defined by the claims appended hereto.

What is claimed is:

1. An imaging device, comprising:

at least one photoconductive member;

at least one developer unit for developing a toner image on the at least one photoconductive member;

at least one toner transfer area for transferring the toner image to a sheet of media as the sheet of media passes through the toner transfer area in a media feed direction;

a fuser assembly positioned downstream of the at least one toner transfer area in the media feed direction for fusing toner transferred to the sheet of media;

a frame to which the at least one photoconductive member and the at least one developer unit are mounted, the fuser assembly being removably mounted to the frame; and a locking assembly connected to the frame and selectively engaged with the fuser assembly when the fuser assembly is mounted to the frame, the locking assembly including a lock plate movably positioned along the frame between a first position in which the lock plate engages with the fuser assembly for locking the fuser assembly to the frame and a second position in which the lock plate is disengaged from the fuser assembly to allow the fuser assembly to be disconnected and removed from the frame, wherein the frame comprises a mounting plate to which the fuser assembly is selectively mounted and includes an aperture through which a feature of the fuser assembly passes to engage and mount the fuser assembly to the mounting plate, and the lock plate is slidable along the mounting plate, wherein when the lock plate is in the first position, the lock plate engages with the feature of the fuser assembly so as to prevent the fuser assembly from disconnecting from the mounting plate and when the lock plate is in the second position, the lock plate disengages from the feature of the fuser assembly so as to allow for the disconnection and removal of the fuser assembly from the frame.

2. The imaging device of claim 1, wherein the feature of the fuser assembly is inserted through the aperture of the mounting plate when the fuser assembly is connected and mounted to the frame, the lock plate moves in proximity to the aperture of the mounting plate and the feature of the fuser assembly such that when the lock plate is in the first position, an edge portion of the lock plate engages with the feature of the fuser assembly so as to prevent the fuser assembly from disconnecting from the mounting plate and when the lock plate is in the second position, the lock plate disengages from the feature of the fuser assembly so as to allow for the disconnection and removal of the fuser assembly from the frame.

3. The imaging device of claim 1, wherein the locking assembly further comprises a bias member connected between the lock plate and the mounting plate, the bias member urging the lock plate towards the second position.

4. The imaging device of claim 3, wherein the locking assembly further comprises a lever mechanism coupled to the lock plate and the mounting plate, wherein actuation of the lever mechanism slides the lock plate from the second position to the first position to lock the fuser assembly to the frame.

5. The imaging device of claim 4, wherein the lever mechanism comprises a first lever member and a second lever member, each of the first and second lever members being rotatably mounted to the mounting plate of the frame, wherein rotation of the first and second lever members slide the lock plate between the first and second positions.

6. The imaging device of claim 5, wherein the mounting plate includes a post, the first lever member includes an annular portion through which the post extends for rotation about the post and an extension portion which extends from the annular portion, and the second lever member includes an annular portion through which the post extends for rotation about the post and an extension portion which extends from the annular portion of the second lever member.

7. The imaging device of claim 6, wherein the locking assembly further comprises a torsion spring coupled to the first lever member and the second lever member, wherein rotation of the first lever member in a first direction causes the torsion spring to urge the second lever member to rotate in the first direction.

8. The imaging device of claim 7, wherein the bias member presents a bias force on the lock plate such that the lock plate is biased against a distal end portion of the second lever member, and a bias force created by the torsion spring on the second lever member when the first lever member is rotated in the first direction overcomes the bias force presented on the lock plate by the bias member so that the second lever rotates in the first direction and the lock plate moves to the first position in response to the first lever member rotating in the first direction.

9. The imaging device of claim 8, wherein the imaging device further comprises a door having a first end portion pivotably coupled to the frame, the door pivoting between a closed position and an open position in which a second end portion of the door is positioned away from the frame, the door including a pivot arm which contacts the first lever member when the door is in the closed position so as to rotate the first lever member in the first direction and cause the lock plate to move to the first position to lock the fuser assembly to the frame.

10. The imaging device of claim 1, wherein the feature includes a first surface which contacts the mounting plate when the fuser assembly is mounted to the frame and a second surface that contacts the lock plate when the lock plate is in the first position, the lock plate being disposed between the second surface of the feature of the fuser assembly and the mounting plate when the lock plate is in the first position.

11. An imaging device, comprising:

at least one photoconductive member;

at least one developer unit for developing a toner image on the at least one photoconductive member;

a toner transfer area for transferring the toner image to a sheet of media as the sheet of media passes through the toner transfer area in a media feed direction;

a fuser assembly positioned downstream of the toner transfer area in the media feed direction for fusing toner transferred to the sheet of media;

a frame to which the at least one photoconductive member, the at least one developer unit and the fuser assembly are removably mounted;

a locking assembly connected to the frame and selectively engaged with the fuser assembly when the fuser assembly is mounted to the frame, the locking assembly including a lock member slidingly coupled to the frame between a first position in which the lock member engages with the fuser assembly for locking the fuser assembly to the frame and a second position in which the lock member is disengaged from the fuser assembly to allow the fuser assembly to be disconnected and removed from the frame, and a lever mechanism movably coupled to the frame and coupled to the lock member, wherein actuation of the lever mechanism moves the lock member between the first position and the second position; and a door member pivotably coupled to the frame so as to pivot between an open position in which an inner space of the imaging device is accessible by a user of the imaging device and a closed position for the imaging device to perform imaging operations, wherein the lever mechanism is actuated by the door member moving from the open position to the closed position so as to move the lock member from the second position to the first position.

12. The imaging device of claim 11, wherein the frame comprises a mounting plate to which the fuser assembly is mountable, the lever mechanism comprises a first lever member rotatably coupled to the frame, a second lever member rotatably coupled to the frame and a third member coupled between the first lever member and the second lever member such that rotation of one of the first lever member and the second lever member rotates the other of the first lever member and the second lever member, the door member moving from the open position to the closed position causes the first lever member to rotate in a first direction.

13. The imaging device of claim 12, wherein the lock member is slidingly coupled to the mounting plate, the mounting plate includes an aperture, the fuser assembly includes a feature which is inserted through the aperture of the mounting plate when the fuser assembly is mounted to the frame and the lock member engages with the feature when the lock member is in the first position.

14. The imaging device of claim 13, wherein when the lock member is in the first position, the lock member covers a portion of the aperture of the mounting plate so as to prevent the feature of the fuser assembly from being withdrawn from the aperture for disconnecting the fuser assembly from the frame.

15. The imaging device of claim 14, wherein when the lock member is in the first position, the lock member is disposed between the mounting plate and the feature.

16. The imaging device of claim 12, wherein the third lever member comprises a first spring member.

17. The imaging device of claim 16, further comprising a second spring member coupled between the mounting plate and the lock member so as to bias the lock member to the second position, the lock member contacting the second lever member such that the second spring member urges rotation of the second lever member in a second direction opposite the first direction.

18. The imaging device of claim 17, wherein rotation of the first lever member in the first direction causes the first spring member to contract and urge the second lever member to rotate in the first direction, a bias force presented to the second lever member by the first spring member due to contraction thereof overcomes a bias force from the second spring member so as to allow the second lever member to rotate in the first direction.

19. A device, comprising:

a plurality of modules operably coupled together to perform a predetermined function;

a frame to which the modules are mounted, a first module being removably mounted to the frame; and a locking assembly connected to the frame and selectively engaged with the first module when the first module is mounted to the frame, the locking assembly including a lock plate slidingly associated with the frame between a first position in which the lock plate engages with the first module for locking the first module to the frame, and a second position in which the lock plate is disengaged from the first module to allow the first module to be disconnected and removed from the frame, and a lever mechanism movably coupled to the frame and coupled to the lock plate, wherein actuation of the lever mechanism moves the lock plate between the first position and the second position, wherein the frame comprises a mounting plate to which the first module is selectively mounted and includes an aperture through which a feature of the first module passes to engage and mount the first module to the mounting plate, and the lock plate is slidable along the mounting plate, wherein when the lock plate is in the first position, the lock plate engages with the feature of the first module so as to prevent the first module from disconnecting from the mounting plate and when the lock plate is in the second position, the lock plate disengages from the feature of the first module so as to allow for the disconnection and removal of the first module from the frame.

20. The device of claim 19, wherein the lever mechanism comprises a first lever member and a second lever member, each of the first and second lever members being rotatably mounted to the mounting plate of the frame, wherein rotation of the first and second lever members slide the lock plate between the first and second positions, wherein the mounting plate includes a post, the first lever member includes an annular portion through which the post extends for rotation about the post and an extension portion which extends from the annular portion, and the second lever member includes an annular portion through which the post extends for rotation about the post and an extension portion which extends from the annular portion of the second lever member, and wherein the locking assembly further comprises a torsion spring coupled to the first lever member and the second lever member, wherein rotation of the first lever member in a first direction causes the torsion spring to urge the second lever member to rotate in the first direction.

21. The device of claim 20, wherein the locking assembly further comprises a bias member connected between the lock plate and the mounting plate, the bias member urging the lock plate towards the second position, and wherein the bias member presents a bias force on the lock plate such that the lock plate is biased against a distal end portion of the second lever member, and a bias force created by the torsion spring on the second lever member when the first lever member is rotated in the first direction overcomes the bias force presented on the lock plate by the bias member so that the second lever rotates in the first direction and the lock plate moves to the first position in response to the first lever member rotating in the first direction.

* * * * *